US005772530A

United States Patent [19]

Kato

[11] Patent Number: 5,772,530

[45] Date of Patent: Jun. 30, 1998

[54] THREAD WOUND GOLF BALL

[75] Inventor: Akira Kato, Shirakawa, Japan

[73] Assignee: Sumitomo Rubber Industries, Ltd., Hyogo-Ken, Japan

[21] Appl. No.: 771,414

[22] Filed: Dec. 20, 1996

[30] Foreign Application Priority Data

Dec. 22, 1995 [JP] Japan ..... 7-350157

[51] Int. Cl.[6] ..... A63B 37/06; A63B 37/12

[52] U.S. Cl. ..... 473/363; 473/365

[58] Field of Search ..... 473/363, 365

[56] References Cited

U.S. PATENT DOCUMENTS 5,048,838 9/1991 Chikaraishi et al. ..... 473/373

5,314,187 5/1994 Proudfit ..... 473/373

5,628,699 5/1997 Maruko et al. ..... 473/363

*Primary Examiner*—George J. Marlo

[57] ABSTRACT

The present invention provides a thread wound golf ball which has good shot feel and good controllability, and attains long flight distance. The thread wound golf ball of the present invention comprises (a) a solid center, (b) a thread rubber layer formed on the solid center, and (c) a cover having a two-layer structure of an inner layer cover and an outer layer cover, the inner layer cover being formed on the thread rubber layer and the outer layer cover being formed on the inner layer cover, wherein the solid center has a diameter of from 29 to 35 mm, the cover contains an ionomer resin as a main component, the inner layer cover has a flexural modulus of from 300 to 600 MPa, and the outer layer cover has a flexural modulus of from 50 to 290 MPa.

2 Claims, 1 Drawing Sheet

THREAD WOUND GOLF BALL

FIELD OF THE INVENTION

The present invention relates to a thread wound golf ball. More particularly, it relates to a thread wound golf ball which has good shot feel and good controllability and attains a flight distance as long as that of a two-piece solid golf ball.

BACKGROUND OF THE INVENTION

A thread wound golf ball is fundamentally composed of a center, a thread rubber layer formed around the center and a cover covering the thread rubber layer. The thread wound golf ball is excellent in shot feel and controllability in comparison with a two-piece solid golf ball, but it has poor flight distance.

OBJECTS OF THE INVENTION

It has been found that there can be obtained a thread wound golf ball, which has good shot feel and good controllability and attains a flight distance as long as that of a two-piece solid golf ball, by using a solid center having a large diameter, i.e. 29–35 mm, an ionomer resin as a main component of the cover and the cover having a two-layer structure of an inner layer cover whose flexural modulus is from 300 to 600 MPa and an outer layer cover whose flexural modulus is from 50 to 290 MPa and adjusting the thickness of a thread rubber layer and that of a cover to a suitable value.

A main object of the present invention is to solve the above problems of a conventional thread wound golf ball, thereby providing a thread wound golf ball which has good shot feel and good controllability and attains a flight distance as long as that of a two-piece solid golf ball.

BRIEF DESCRIPTION OF THE DRAWINGS

This object as well as other objects and advantages of the present invention will become apparent to those skilled in the art from the following description with reference to the accompanying drawings, wherein.

SUMMARY OF THE INVENTION

Figure 1:
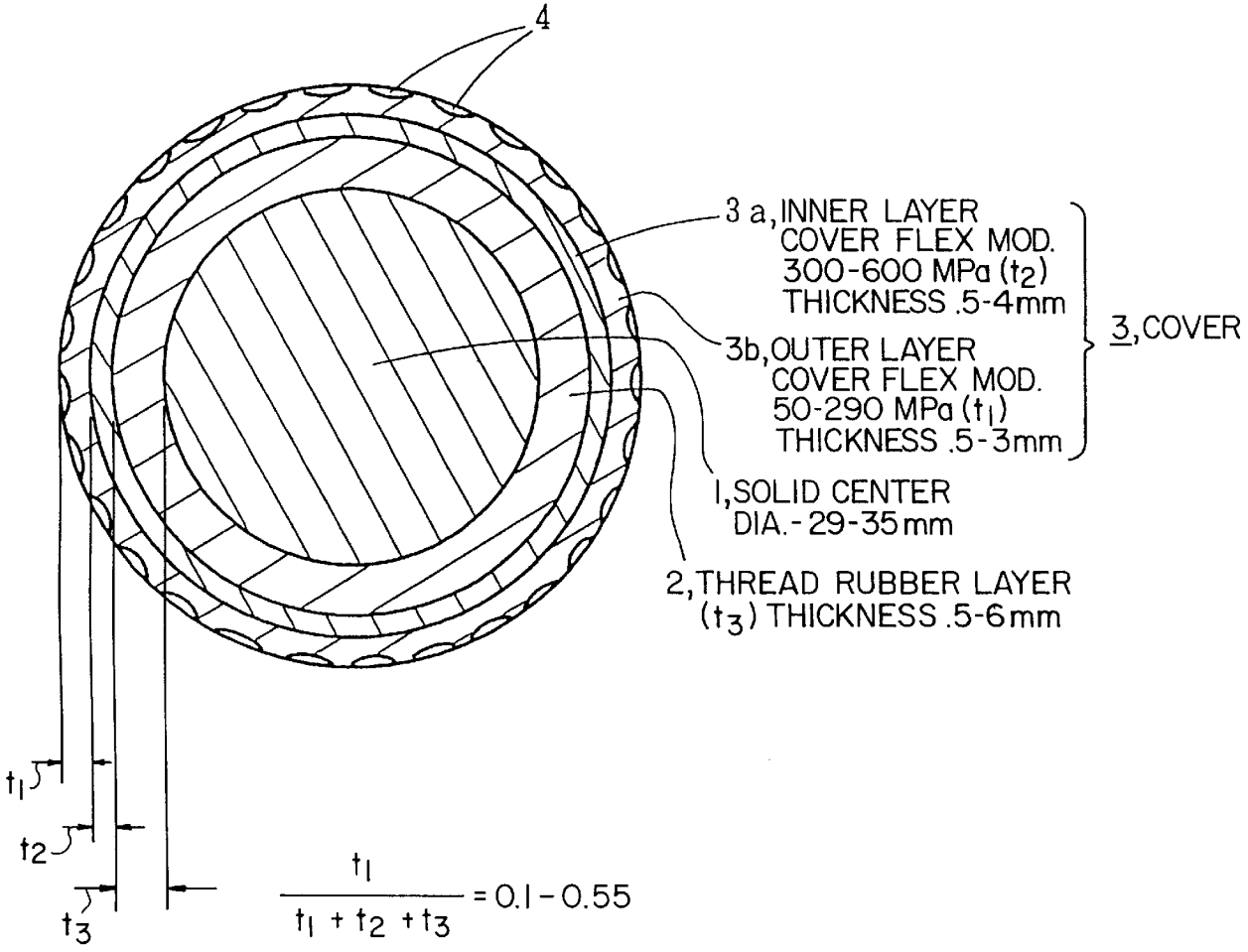
FIG. 1 is a schematic cross section illustrating one embodiment of the thread wound golf ball of the present invention.

The present invention provides a thread wound golf ball comprising (a) a solid center, (b) a thread rubber layer formed on the solid center, and (c) a cover having a two-layer structure of an inner layer cover and an outer layer cover, the inner layer cover being formed on the thread rubber layer and the outer layer cover being formed on the inner layer cover, wherein the solid center has a diameter of from 29 to 35 mm, the cover contains an ionomer resin as a main component, the inner layer cover has a flexural modulus of from 300 to 600 MPa, and the outer layer cover has a flexural modulus of from 50 to 290 MPa.

DETAILED DESCRIPTION OF THE INVENTION

The solid center used in the present invention has a large diameter, i.e. 29–35 mm, preferably 30 to 34 mm. It is preferred that the solid center has an amount of deformation, formed by applying a load to the solid center within the range from an initial load of 10 Kg to a final load of 30 Kg, of from 1 to 2.5 mm, preferably 1.1 to 2.3 mm.

If the diameter of the solid center is smaller than 29 mm, the spin amount at the time of hitting is too large and the flight distance is lowered. On the other hand, when the diameter of the solid center is larger than 35 mm, the thread wound layer formed thereon is thin and the rebound characteristics of the thread rubber are not sufficiently utilized. As a result, it is difficult to attain a long distance and also the shot feel is poor. When the deformation amount of the solid center is larger than 2.5 mm, the solid center is too soft and, therefore, the thread rubber must be tightly wound to obtain a suitable ball hardness. Accordingly, the tension of the thread rubber layer is too large and the deformation at the time of hitting is not easily formed and, therefore, the improvement in flight distance is not obtained. On the other hand, when the deformation amount of the solid center is smaller than 1 mm under the above conditions, the solid center is too hard and shot feel is poor.

When the flexural modulus of the inner layer cover is smaller than 300 MPa, rebound characteristics are degraded and flight distance is lowered. On the other hand, when the flexural modulus of the inner layer cover is larger than 600 MPa, the inner layer cover is too hard and shot feel is poor. It is to be noted that MPa is an abbreviation for mega pascal which is a unit of pressure equal to the pressure resulting from a force of $10^6$ Newtons acting uniformly over an area of one (1) square meter.

When the flexural modulus of the outer layer cover is smaller than 50 MPa, the outer layer cover is too soft and the spin amount increases too much and, therefore, the cut resistance is degraded. On the other hand, when the flexural modulus of the outer layer cover is larger than 290 MPa, it is impossible to put a desired spin on the ball and controllability is poor and the shot feel is poor.

When the value of the (thickness of the outer layer cover $t_1$)/(thickness of the thread rubber layer $t_3$+thickness of the inner layer cover $t_2$+thickness of the outer layer cover $t_1$) is smaller than 0.1, the rebound characteristics of the golf ball is enhanced but the spin is not easily put on the golf ball. Accordingly, controllability is poor and shot feel is also poor. On the other hand, when the value of the (thickness of the outer layer cover $t_1$)/(thickness of the thread rubber layer $t_3$+thickness of the inner layer cover $t_2$+thickness of the outer layer cover $t_1$) is larger than 0.55, the proportion of the outer layer cover having low rigidity and low rebound characteristics is large and, therefore, the rebound characteristics of the golf ball are degraded and long flight distance is not attained.

The solid center is obtained by subjecting the rubber composition to vulcanization molding. The rubber composition is generally composed of a rubber component and some additives. The rubber component is not specifically limited, and is preferably polybutadiene which shows high rebound characteristics, particularly high-cis polybutadiene. In the preparation of the rubber composition for a solid center, it is preferred to use high-cis polybutadiene as the rubber component or the main component. The high-cis polybutadiene can also be used in the preparation of a rubber composition according to the sulfur vulcanization system and a rubber composition according to the peroxide vulcanization system due to an $\alpha,\beta$-unsaturated carboxylic acid metal salt. Preferred is the peroxide vulcanization system. The rubber composition for the peroxide vulcanization system can be composed of a high-cis polybutadiene rubber, an α,β-unsaturated carboxylic acid metal salt (e.g. zinc acrylate), a peroxide (e.g. dicumyl peroxide), a filler (e.g. zinc oxide and barium sulfate) and an antioxidant.

The thread rubber layer is formed by winding a thread rubber in a stretched state around the above solid center. The thread rubber can be the same one which has hitherto been used for thread wound golf balls. For example, it can be those obtained by vulcanizing a rubber composition obtained by formulating sulfur, a vulcanization aid, a vulcanization accelerator, an antioxidant, etc. in a natural rubber or natural rubber and synthetic polyisoprene.

In the present invention, the inner layer cover can be a high-rigid resin having a flexural modulus of 300–600 MPa, preferably 310 to 500 MPa, obtained by using an ionomer resin or a mixture thereof. The ionomer resin is generally obtained by neutralizing at least one portion of carboxyl groups in a copolymer of an α-olefin and an α,β-unsaturated carboxylic acid having 3 to 8 carbon atoms with a metal ion. Specific examples of the ionomer resin are high-rigid grade ionomer resins which are commercially available from Mitsui Du Pont Polychemical Co., Ltd. under the trade name of "Hi-milan 1605 (Na)", "Hi-milan 1707 (Na)", "Hi-milan AM7318 (Na)", "Hi-milan AM7315 (Zn)", "Hi-milan AM7317 (Zn)" and the like; high-rigid grade ionomer resins which are commercially available from Du Pont USA Co. under the trade name of "Surlyn 8940 (Na)", "Surlyn 8920 (Na)", "Surlyn 7940 (Li)" and the like; and high-rigid grade ionomer resins which are commercially available from Exxon chemical Co. under the trade name of "lotek 8000 (Na)". Also, Na, Zn, Li, etc., which are described in parentheses at the back of the trade name of the above ionomer resin show neutralization metal ion species, respectively. When using a mixture of ionomer resins as the base resin, an ionomer resin having a rigidity lower than that of an ionomer resin mixed with a high-rigid ionomer resin can also be used, in addition to the high-rigid ionomer resin.

In the present invention, the outer layer cover can be formed from a resin having a flexural modulus of 50–290 MPa, preferably 80 to 250 MPa, which contains an ionomer resin as the resin component. The resin component of the outer layer cover may be composed of merely an ionomer resin, but may also be a heated mixture of an ionomer resin and a glycidyl group-modified thermoplastic elastomer, a heated mixture of an ionomer resin, a maleic anhydride-modified thermoplastic elastomer and a glycidyl group-modified thermoplastic elastomer, or a heated mixture of an ionomer resin and a three-dimensional copolymer of ethylene, an unsaturated carboxylate and an unsaturated carboxylic acid.

Examples of the low-rigid ionomer resin suitable for the resin component of the outer layer cover are terpolymer ionomer resins which are commercially available from Mitsui Du Pont Polychemical Co., Ltd. under the trade name of "Hi-milan 1856 (Na)", "Hi-milan 1855 (Zn)", "Hi-milan AM7316 (Zn)" and the like; and terpolymer ionomer resins which are commercially available from Du Pont USA Co. under the trade name of "Surlyn AD8265 (Na)", "Surlyn AD8269 (Na)" and the like. When the resin component of the outer layer cover is composed of a mixture of the ionomer resins and other ionomer resins, or a mixture of ionomer resins and other thermoplastic elastomers, those other than the above ionomer resins can also be used as the ionomer resin.

Examples of the above glycidyl group-modified thermoplastic elastomer are ethylene-glycidyl methacrylate-methyl acrylate terpolymer and ethylene-glycidyl methacrylate-vinyl acetate terpolymer, which are commercially available from Sumitomo Chemical Industries Co., Ltd. under the trade name of "Bondfast"; glycidyl methacrylate adducts of hydrogenated styrene-butadiene-styrene block copolymers, which are commercially available from Asahi Chemical Industry Co., Ltd. under the trade name of "Taftek Z5" and "Taftek Z513"; and ethylene-acrylate-glycidyl methacrylate terpolymer, which is commercially available from Du Pont USA under the trade name of "Elvaloy-AS".

Examples of the above maleic anhydride-modified thermoplastic elastomer are maleic anhydride adducts of hydrogenated styrene-butadiene-styrene block copolymers, which are commercially available from Asahi Chemical Industry Co., Ltd. under the trade name of "Taftek M series"; ethylene-ethyl acrylate-maleic anhydride terpolymers, which are commercially available from Sumitomo Chemical Industries Co., Ltd. under the trade name of "Bondine"; and products obtained by graft-modifying ethylene-ethyl acrylate copolymers with maleic anhydride, which are commercially available from Mitsui Du Pont Polychemical Co., Ltd. under the trade name of "AR series".

Examples of the ethylene-unsaturated carboxylate-unsaturated carboxylic acid terpolymers are ethylene-isobutyl acrylate-methacrylic acid terpolymers which are commercially available from Mitsui Du Pont Polychemical Co., Ltd. under the trade name of "Neucrel AN4212C", "Neucrel N0805J" and the like.

When the resin component of the outer cover is composed of the mixture of the ionomer resin and other resin, a mixing ratio of them is not specifically limited but is adjusted so that the flexural modulus of the outer layer cover is within the range from 50 to 290 MPa. For example, the weight ratio of the ionomer resin to the other resin (e.g. glycidyl group-modified thermoplastic elastomer, maleic anhydride-modified thermoplastic elastomer, ethylene-unsaturated carboxylate-unsaturated carboxylic acid terpolymer, etc.) is preferably adjusted within the range from about 95:5 to 55:45.

In the present invention, various additives such as pigments, dispersants, antioxidants, UV absorbers, photostabilizers, etc. can be optionally added, in addition to the resin component, in the preparation of the cover composition which constitutes the inner layer cover and outer layer cover.

In the present invention, the flexural modulus of the inner layer cover and outer layer cover is specified, and the flexural modulus is measured after producing a sample from the cover composition. The reason is as follows. That is, once the golf ball is produced, the flexural modulus of the cover of the golf ball is difficult to measure by a current technique and, therefore, the measurement of the flexural modulus must be conducted after producing a sample from the cover composition. Since the flexural modulus of the cover and that of the cover composition are substantially the same, the flexural modulus of the inner layer cover and outer layer cover measured after producing a sample from the cover composition is taken as the modulus of the inner layer cover and outer layer cover in the present invention. The cover composition contains the resin component as the main component and a small amount of additives such as pigment is merely added in addition to the base resin. Therefore, it is considered that the flexural of the cover composition and that of the base resin are substantially the same.

The flexural modulus of the inner layer cover and outer layer cover is determined according to ASTM D-747 after a hot-press molded sheet having a thickness of about 2 mm is obtained from the cover composition and preserved at 23° C. for two weeks.

A method of covering the inner layer cover and outer layer cover is not specifically limited, but may be a conventional method. For example, it can be a method comprising molding the composition for the inner layer cover into a semi-spherical half-shell in advance, covering a core (a thread wound core of a solid center and a thread rubber layer) with two half-shells, followed by subjecting it to pressure molding at 130° to 170° C. for 1 to 5 minutes, or a method comprising injection-molding the composition for the inner layer cover directly to cover the core. Regarding the outer layer cover, the same covering method as that used in case of the inner layer cover is used. That is, it can be a method comprising molding the composition for outer layer cover into a semi-spherical half-shell in advance, covering a core with two half-shells, followed by subjecting to pressure molding at 130° to 170° C. for 1 to 5 minutes, or a method comprising injection-molding the composition for outer layer cover directly to cover the core. In case of forming the outer layer cover, dimples may be optionally formed on the surface of the outer layer cover. Further, a paint or marking may be optionally provided after the outer layer cover was formed.

A thickness of the thread rubber layer, inner layer cover and outer layer cover is not specifically limited, but is adjusted so that the value of (thickness of the outer layer cover)/(thickness of the thread rubber layer+thickness of the inner layer cover+thickness of the outer layer cover) is within the range from 0.1 to 0.55. The thickness of the thread rubber layer is employed within the range from 0.5 to 6 mm. The thickness of the inner layer cover is employed within the range from 0.5 to 4 mm. The thickness of the outer layer cover is employed within the range from 0.5 to 3 mm.

One embodiment of the thread wound golf ball of the present invention will be explained with reference to the accompanying drawing. FIG. 1, 1 is a solid center, 2 is a thread rubber layer, 3 is a cover. The cover 3 has a two-layer structure of an inner layer cover 3*a* and an outer layer cover 3*b*. 4 indicates dimples provided on the surface of the outer layer cover 3*b*.

The solid center 1 is composed of a vulcanized molded article of the rubber composition. A diameter thereof is from 29 to 35 mm and an amount of deformation formed by applying a load to the solid center 1 within the range from an initial load of 10 Kg to a final load of 30 Kg is preferably within the range from 1 to 2.5 mm.

The thread rubber layer 2 is formed by winding the thread rubber in the stretched state around the solid center 1, and a so-called thread wound core is formed by the solid center 1 and thread rubber layer 2.

The periphery of the thread rubber layer 2 is covered with the inner layer cover 3*a* and the flexural modulus of the inner layer cover 3*b* is from 300 to 600 MPa. The periphery of the inner layer cover 3*a* is covered with the outer layer cover 3*b* and the flexural modulus of the outer layer cover 3*b* is from 50 to 300 MPa. Regarding the thread rubber layer 2, inner layer cover 3*a* and outer layer cover 3*b*, the value of (thickness of the outer layer cover 3*b*)/(thickness of the thread rubber layer+thickness of the inner layer cover+thickness of the outer layer cover) namely, $t_1/(t_3+t_2+t_1)$ is preferably within the range from 0.1 to 0.55.

Dimples 4 are optionally provided on the surface of the outer layer cover 3*b* according to the desired characteristics.

As described above, the present invention can provide a thread wound golf ball which has goof shot feel and good controllability and attains long flight distance.

EXAMPLES

The following Examples and Comparative Examples further illustrate the present invention in detail, but are not to be construed to limit the present invention to their details.

Examples 1 to 5 and Comparative Examples 1 to 11

Among the golf balls of Examples 1 to 5 and Comparative Examples 1 to 11, the thread wound golf balls of Examples 1 to 5 and Comparative Examples 1 to 9 were produced through the following steps (1) to (3). The golf ball of Comparative Example 10 is a commercially available two-piece golf ball using a high-rigid ionomer resin and the golf ball of Comparative Example 11 is a commercially available thread wound golf ball using a balata cover.

(1) Production of Solid Center and Thread Wound Core

A rubber composition for solid center was prepared according to the composition shown in Table 1, and then the resulting rubber composition was charged in a mold for solid center and vulcanized by heating at 155° C. under pressure for 20 minutes to produce solid centers A to G. An amount of each component shown in the Table 1 is represented by parts by weight, and it is also the same in the following tables.

The diameter, weight, surface hardness (hardness measured by using a JIS-C type hardness tester) and deformation amount of the resulting solid center are shown in Table 1. The deformation amount is determined by measuring an amount of deformation formed by applying a load to the solid center within the range from an initial load of 10 Kg to a final load of 30 Kg.

TABLE 1

| | A | B | C | D | E | F | G |
|---|---|---|---|---|---|---|---|
| JSR BR11 *1 | 100 | 100 | 100 | 100 | 100 | 100 | 100 |
| Zinc acrylate | 15 | 15 | 15 | 15 | 15 | 3 | 25 |
| Dicumyl peroxide | 1.5 | 1.5 | 1.5 | 1.5 | 1.5 | 1.5 | 1.5 |
| Zinc oxide | 15 | 15 | 15 | 15 | 15 | 15 | 15 |
| Barium sulfate | 104 | 84 | 60 | 41 | 32 | 63 | 59 |
| Noclak NS-6 *2 | 0.5 | 0.5 | 0.5 | 0.5 | 0.5 | 0.5 | 0.5 |
| Physical properties of solid center | | | | | | | |
| Diameter (mm) | 28.1 | 30.1 | 32.1 | 34.1 | 35.1 | 32.1 | 32.1 |
| Weight (g) | 18.5 | 21.5 | 24.2 | 26.9 | 28.3 | 24.2 | 24.3 |
| Surface hardness (JIS-C) | 61 | 60 | 60 | 60 | 59 | 35 | 73 |
| Deformation amount (mm) | 1.45 | 1.47 | 1.50 | 1.52 | 1.54 | 2.55 | 0.85 |

*1: Trade name high-cis polybutadiene (content of 1,4-cis-polybutadine: 96%) manufactured by Japan Synthetic Rubber Co., Ltd.
*2: Trade name, antioxidant (2,5-di-tertiary-butylhydroquinone) manufactured by Nihon Ohuchi Shinko Kagaku Kogyo Co., Ltd.

A thread wound core having an outer diameter of about 36.7 mm was produced by winding a thread rubber whose base rubber is composed of a natural rubber/low cis-synthesized polyisoprene (weight ratio: 50/50) [Shell IR-309 (trade name), manufactured by Shell Chemical Co.] in the stretched state around the above solid center.

(2) Preparation of Cover Composition

A formulation material having the composition shown in Table 2 was mixed using a twin-screw kneading type extruder to obtain pelletized cover compositions a to f.

The extrusion conditions were as follows: a screw diameter: 45 mm; a screw revolution per minute: 200 rpm; a screw L/D: 35. The formulation components were heated at 200° to 260° C. at the die position of the extruder. Then, the flexural modulus and shore D-scale hardness of the resulting cover composition were measured. The results are shown in Table 2. The flexural modulus was measured according to ASTM D-747 after a hot-press molded sheet having a thickness of about 2 mm was obtained from each composition of cover and preserved at 23° C. for two weeks. The Shore D-scale hardness was measured according to ASTM D-2240 after a hot-press molded sheet having a thickness of about 2 mm was obtained from each cover composition and preserved at 23° C. for two weeks in the same manner as the case of flexural modulus.

TABLE 2

| | a | b | c | d | e | f |
|---|---|---|---|---|---|---|
| Hi-milan 1605 *3 | 0 | 20 | 20 | 25 | 50 | 0 |
| Hi-milan 1557 *4 | 0 | 5 | 0 | 25 | 0 | 0 |
| Hi-milan 1855 *5 | 20 | 75 | 30 | 50 | 0 | 0 |
| Hi-milan 1706 *6 | 0 | 0 | 20 | 0 | 50 | 0 |
| Surlyn AD 8511 *7 | 25 | 0 | 0 | 0 | 0 | 0 |
| Surlyn AD 8512 *8 | 25 | 0 | 0 | 0 | 0 | 0 |
| Neucrel AN4212C *9 | 0 | 0 | 30 | 0 | 0 | 0 |
| Taftek Z514 *10 | 20 | 0 | 0 | 0 | 0 | 0 |
| Bondine AX8390 *11 | 10 | 0 | 0 | 0 | 0 | 0 |
| Iotek 8000 *12 | 0 | 0 | 0 | 0 | 0 | 60 |
| Iotek 7010 *13 | 0 | 0 | 0 | 0 | 0 | 40 |
| Titanium dioxide | 2 | 2 | 2 | 2 | 2 | 2 |
| Barium sulfate | 2 | 2 | 2 | 2 | 2 | 2 |
| Flexural modulus (MPa) | 135 | 150 | 150 | 220 | 330 | 390 |
| Shore D-scale hardness | 50 | 56 | 54 | 58 | 63 | 66 |

(3) Production of Thread Wound Golf Ball

A thread wound golf ball having an outer diameter of 42.7 mm was obtained by molding a semi-spherical half-shell from the composition for inner layer cover of the above item (2), covering the thread wound core of the above item (1) with two half-shells, press-molding in a mold for golf ball at 150° C. for 3 minutes, injection-molding the composition for outer layer cover of the above item (2) directly on the inner layer cover, and then applying paint thereon. A combination of the solid center, inner layer cover and outer layer cover, the thickness of the thread rubber layer, and the flexural modulus and thickness of the inner layer cover and outer layer cover are shown in Tables 3 to 5. In Tables 3 to 5, the thickness of the thread rubber layer is indicated by (a), the thickness of the inner layer cover is indicated by (b), the thickness of the outer layer cover is indicated by (c) and the value of (thickness of the outer layer cover)/(thickness of the thread rubber layer+thickness of the inner layer cover+thickness of the outer layer cover) is indicated by (c)/(a+b+c), respectively. In Tables 3 to 5, the solid center, inner layer cover and outer layer cover are indicated by their symbols center, a to f in case of the inner layer cover and outer layer cover).

TABLE 3

| | Example No. | | | | |
|---|---|---|---|---|---|
| | 1 | 2 | 3 | 4 | 5 |
| Solid center | B | C | C | C | D |
| Thickness of thread rubber layer (mm) (a) | 3.3 | 2.3 | 2.3 | 2.3 | 1.3 |
| Inner layer cover | e | e | f | e | e |
| Flexural modulus (MPa) | 330 | 330 | 390 | 330 | 330 |
| Thickness (mm) (b) | 1.5 | 1.5 | 1.5 | 1.5 | 1.5 |
| Outer layer cover | b | c | b | a | b |

TABLE 3-continued

| | Example No. | | | | |
|---|---|---|---|---|---|
| | 1 | 2 | 3 | 4 | 5 |
| Flexural modulus (MPa) | 150 | 150 | 150 | 135 | 150 |
| Thickness (mm) (c) | 1.5 | 1.5 | 1.5 | 1.5 | 1.5 |
| (c)/(a + b + c) | 0.24 | 0.28 | 0.28 | 0.28 | 0.35 |

TABLE 4

| | Comparative Example No. | | | | |
|---|---|---|---|---|---|
| | 1 | 2 | 3 | 4 | 5 |
| Solid center | C | C | C | C | C |
| Thickness of thread rubber layer (mm) (a) | 2.3 | 2.3 | 1.5 | 3.3 | 0 |
| Inner layer cover | d | f | e | e | e |
| Flexural modulus (MPa) | 220 | 390 | 330 | 330 | 330 |
| Thickness (mm) (b) | 1.5 | 1.5 | 0.8 | 1.5 | 3.8 |
| Outer layer cover | b | e | b | b | b |
| Flexural modulus (MPa) | 150 | 330 | 150 | 150 | 150 |
| Thickness (mm) (c) | 1.5 | 1.5 | 3.0 | 0.5 | 1.2 |
| (c)/(a + b + c) | 0.28 | 0.28 | 0.57 | 0.09 | 0.24 |

TABLE 5

| | Comparative Example No. | | | |
|---|---|---|---|---|
| | 6 | 7 | 8 | 9 |
| Solid center | A | E | F | G |
| Thickness of thread rubber layer (mm) (a) | 4.3 | 0.8 | 2.3 | 2.3 |
| Inner layer cover | e | e | e | e |
| Flexural modulus (MPa) | 330 | 330 | 330 | 330 |
| Thickness (mm) (b) | 1.5 | 1.5 | 1.5 | 1.5 |
| Outer layer cover | b | b | b | b |
| Flexural modulus (MPa) | 150 | 150 | 150 | 150 |
| Thickness (mm) (c) | 1.5 | 1.5 | 1.5 | 1.5 |
| (c)/(a + b + c) | 0.21 | 0.39 | 0.28 | 0.28 |

The weight and flight performance of the resulting thread wound golf ball were measured. A swing robot manufactured by True Temper Co. was used for the measurement of the flight performance. The flight performance 1 was measured by mounting a No. 1 wood club to the swing robot and hitting the golf ball at a head speed of 45 m/second. The flight performance 2 was measured by mounting a No. 9 iron club to the swing robot and hitting the golf ball at a head speed of 34 m/second. The results are shown in Tables 6 to 9. Regarding the flight performance 1, the ball velocity and carry (distance to dropped point) are shown. Regarding the flight performance 2, the ball velocity, spin amount, carry, run (rolling distance from dropped point) and total (obtained by adding run to carry) are shown. In the tables, the No. 1 wood club is represented by "No. 1 wood" and No. 9 iron club is represented by "No. 9 iron".

The shot feel of the resulting golf ball was evaluated by 10 top professional golfers according to a practical hitting test using a No. 1 wood club. The evaluation criteria are as follows. The results shown in the Tables below are based on the fact that not less than 8 out of 10 professional golfers evaluated with the same criterion about each test item.

Evaluation Criteria

○: Soft feeling and good

X: Hard and poor

The evaluation results of the physical properties and shot feel of the golf balls of Examples 1 to 5 are shown in Table 6, together with the solid center, inner layer cover, outer layer cover and (c)/(a+b+c) [i.e. (thickness of the outer layer cover)/(thickness of the thread rubber layer+thickness of the inner layer cover+thickness of the outer layer cover)] used in the production of the golf ball. Those of Comparative Examples 1 to 5 and those of the golf balls of Comparative Examples 6 to 9 are shown in Table 7 and Table 8, respectively. The ball weight, physical properties and shot feel of the golf balls of Comparative Examples 10 to 11 are shown in Table 9.

TABLE 6

| | Example No. | | | | |
|---|---|---|---|---|---|
| | 1 | 2 | 3 | 4 | 5 |
| Solid center | B | C | C | C | D |
| Inner layer cover | e | e | f | e | e |
| Outer layer cover | b | c | b | a | b |
| (c)/(a + b + c) | 0.24 | 0.28 | 0.28 | 0.28 | 0.35 |
| Ball weight (g) | 45.4 | 45.3 | 45.3 | 45.3 | 45.4 |
| Flight performance 1 (No. 1 wood) | | | | | |
| Ball initial velocity (m/s) | 63.9 | 64.5 | 64.7 | 64.2 | 64.9 |
| Carry (yard) | 223.0 | 223.5 | 224.2 | 223.2 | 224.5 |
| Flight performance 2 (No. 9 iron) | | | | | |
| Ball initial velocity (m/s) | 46.3 | 46.5 | 46.7 | 46.1 | 46.7 |
| Spin amount (rpm) | 8470 | 8450 | 8430 | 8600 | 8440 |
| Carry (yard) | 131.9 | 132.1 | 132.4 | 132.0 | 132.4 |
| Run (yard) | 1.2 | 1.2 | 1.3 | 0.9 | 1.3 |
| Total (yard) | 133.1 | 133.3 | 133.7 | 132.9 | 133.7 |
| Shot feel | ○ | ○ | ○ | ○ | ○ |

TABLE 7

| | Comparative Example No. | | | | |
|---|---|---|---|---|---|
| | 1 | 2 | 3 | 4 | 5 |
| Solid center | C | C | C | C | C |
| Inner layer cover | d | f | e | e | e |
| Outer layer cover | b | e | b | b | b |
| (c)/(a + b + c) | 0.28 | 0.28 | 0.57 | 0.09 | 0.24 |
| Ball weight (g) | 45.3 | 45.3 | 45.4 | 45.3 | 45.4 |
| Flight performance 1 (No. 1 wood) | | | | | |
| Ball initial velocity (m/s) | 62.5 | 65.4 | 62.1 | 65.2 | 63.2 |
| Carry (yard) | 218.0 | 224.8 | 217.5 | 224.6 | 221.3 |
| Flight performance 2 (No. 9 iron) | | | | | |
| Ball initial velocity (m/s) | 44.0 | 47.1 | 43.5 | 46.9 | 45.0 |
| Spin amount (rpm) | 8550 | 7250 | 8600 | 7950 | 8100 |
| Carry (yard) | 129.5 | 133.5 | 129.3 | 132.8 | 130.3 |
| Run (yard) | 1.1 | 1.7 | 0.8 | 1.5 | 1.5 |
| Total (yard) | 130.6 | 135.2 | 130.1 | 134.3 | 131.3 |
| Shot feel | ○ | X | ○ | X | X |

TABLE 8

| | Comparative Example No. | | | |
|---|---|---|---|---|
| | 6 | 7 | 8 | 9 |
| Solid center | A | E | F | G |
| Inner layer cover | e | e | e | e |
| Outer layer cover | b | b | b | b |
| (c)/(a + b + c) | 0.21 | 0.39 | 0.28 | 0.28 |
| Ball weight (g) | 45.3 | 45.3 | 45.3 | 45.3 |
| Flight performance 1 (No. 1 wood) | | | | |
| Ball initial velocity (m/s) | 64.6 | 62.8 | 64.0 | 64.5 |
| Carry (yard) | 220.3 | 218.5 | 220.5 | 221.0 |
| Flight performance 2 (No. 9 iron) | | | | |
| Ball initial velocity (m/s) | 46.6 | 43.7 | 45.9 | 46.6 |
| Spin amount (rpm) | 8500 | 8450 | 8400 | 8580 |

TABLE 8-continued

| | Comparative Example No. | | | |
|---|---|---|---|---|
| | 6 | 7 | 8 | 9 |
| Carry (yard) | 131.5 | 129.4 | 131.3 | 132.0 |
| Run (yard) | 1.1 | 1.0 | 1.3 | 1.2 |
| Total (yard) | 132.6 | 130.4 | 132.6 | 133.2 |
| Shot feel | ○ | ○ | ○ | X |

TABLE 9

| | Comparative Example No. | |
|---|---|---|
| | 10 | 11 |
| Solid center | Standard two-piece solid golf ball | Standard thread wound golf ball using balata cover |
| Inner layer cover | | |
| Outer layer cover | | |
| (c)/(a + b + c) | | |
| Ball weight (g) | 45.3 | 45.3 |
| Flight performance 1 (No. 1 wood) | | |
| Ball initial velocity (m/s) | 64.6 | 64.5 |
| Carry (yard) | 223.2 | 220.1 |
| Flight performance 2 (No. 9 iron) | | |
| Ball initial velocity (m/s) | 46.7 | 46.4 |
| Spin (rpm) | 6800 | 8550 |
| Carry (yard) | 133.2 | 130.3 |
| Run (yard) | 2.3 | 1.0 |
| Total (yard) | 135.5 | 131.3 |
| Shot feel | X | ○ |

As is apparent from a comparison between the physical properties of the golf balls of Examples 1 to 5 shown in Table 6 and those of Comparative Examples 1 to 11 shown in Tables 7 to 9, the golf balls of Examples 1 to 5 had good shot feel, a large amount of spin due to No. 9 iron club and good controllability due to approach iron shot, and also attained large flight distance due to a No. 1 wood club (driver) and had a flight distance as long as that of Comparative Example 10 as a standard two-piece solid golf ball.

The reason why the physical properties of the golf balls of Examples 1 to 5 are excellent that, as shown in Table 3, solid centers B, C and D having a diameter within the range from 30 to 35 mm and a deformation amount within the range from 1 to 2.5 mm (see Table 1), an inner layer cover having a flexural modulus within the range from 300 to 600 MPa and an outer layer cover having a flexural modulus within the range from 50 to 290 MPa are used and a value of (c)/(a+b+c) [i.e. (thickness of the outer layer cover)/(thickness of the thread rubber layer+thickness of the inner layer cover+thickness of the outer layer cover)] is adjusted within the range from 0.1 to 0.55 in Examples 1 to 5.

To the contrary, the golf ball of Comparative Example 1 showed good shot feel and good controllability (controllability is judged by an amount of spin due to a No. 9 iron club), but the flight distance was short (flight distance is judged by a carry due to a No. 1 wood club). This reason is considered that the flexural modulus of the inner layer cover of the golf ball of Comparative Example 1 was small, i.e. 220 MPa (see Table 4). The golf ball of Comparative Example 2 attained large flight distance but was poor in shot feel and controllability. This reason is considered that the flexural modulus of the outer layer cover of the golf ball of Comparative Example 2 was large, i.e. 330 MPa (see Table 4).

The golf ball of Comparative Example 3 has excellent shot feel, but the flight distance was short. The golf ball of Comparative Example 4 attained long flight distance but was poor in shot feel and was insufficient in controllability. Regarding the golf ball of Comparative Example 3, since the thickness of the outer layer cover having low rigidity and low rebound characteristics is large, the value of (thickness of the outer layer cover)/(thickness of the thread rubber layer+thickness of the inner layer cover+thickness of the outer layer cover) is larger than 0.55 in Comparative Example 3. On the contrary, regarding the golf ball of Comparative Example 4, because the thickness of the outer layer cover having low rigidity is small, the above value is smaller than 0.1.

The golf ball of Comparative Example 5 has poor shot feel because no thread rubber layer is provided (see Table 4), and the golf balls of Comparative Examples 6 and 7 were insufficient in flight distance. The reason why the flight distance of the golf balls of Comparative Examples 6 and 7 is not sufficient is considered that the diameter of the solid center is small in the golf ball of Comparative Example 6 (see Table 1) and the spin amount is large while the diameter of the solid center is too large in the golf ball of Comparative Example 7 (see Table 1) and the thread rubber layer is thin (see Table 5).

The golf ball of Comparative Example 8 was not sufficient in flight distance and the golf ball of Comparative Example 9 has poor shot feel. This reason is considered that the solid center is too soft and the deformation amount is large in the golf ball of Comparative Example 8 (see Table 1) while the solid center is too hard and the deformation amount is small in the golf ball of Comparative Example 9 (see Table 1).

The golf ball of Comparative Example 10 attained long flight distance because it is a two-piece solid golf ball using a high-rigid ionomer resin cover, but it had poor shot feel and poor controllability and had a small spin amount. The golf ball of Comparative Example 11 had excellent shot feel and excellent controllability and had a large spin amount because it is a thread wound golf ball using a balata cover, but attained poor flight distance.

What is claimed is:

1. A thread wound golf ball comprising:

(a) a solid center, (b) a thread rubber layer formed on the solid center, and (c) a cover having a two-layer structure of an inner layer cover and an outer layer cover, the inner layer cover being formed on the thread rubber layer and the outer layer cover being formed on the inner layer cover, wherein the solid center has a diameter of from 29 to 35 mm, the cover contains an ionomer resin as a main component, the inner layer cover has a flexural modulus of from 300 to 600 MPA, the outer layer cover has a flexural modulus of from 50 to 290 MPa, and a value of $t_1/(t_3+t_2+t_1)$ is within the range from 0.1 to 0.55, with $t_1$ being the thickness of the outer layer cover, $t_2$ being the thickness of the inner layer cover, and $t_3$ being the thickness of the thread rubber layer.

2. The thread wound golf ball according to claim 1, wherein an amount of deformation, formed by applying a load to the solid center within the range from an initial load of 10 kg to a final load of 30 kg, is from 1 to 2.5 mm.

* * * * *